US005575251A

United States Patent [19]

Bock

[11] Patent Number: 5,575,251

[45] Date of Patent: Nov. 19, 1996

[54] DECK PLATE FOR AN INTERNAL COMBUSTION ENGINE

[75] Inventor: Allyn P. Bock, West Lafayette, Ind.

[73] Assignee: Caterpillar Inc., Peoria, Ill.

[21] Appl. No.: 177,045

[22] Filed: Jan. 4, 1994

[51] Int. Cl.[6] ..... F02B 75/08

[52] U.S. Cl. ..... 123/193.3; 123/193.2

[58] Field of Search ..... 123/193.1, 193.2, 123/193.3, 193.4, 41.84, 668, 669; 29/888.011, 888.06, 888.061

[56] References Cited

U.S. PATENT DOCUMENTS

| | | | |
|---|---|---|---|
| 2,744,514 | 5/1956 | Vidmar | 123/193.3 |
| 4,305,348 | 12/1981 | Martin | 123/41.84 |
| 4,757,790 | 7/1988 | Ushio et al. | 123/193.2 |
| 4,791,891 | 12/1988 | Kubis et al. | 123/193.2 |
| 4,856,462 | 8/1989 | Ushio et al. | 123/41.84 |
| 5,251,579 | 10/1993 | Morris | 123/41.84 |
| 5,299,538 | 4/1994 | Kennedy | 123/41.84 |
| 5,377,643 | 1/1995 | Schibalsky | 123/193.3 |

*Primary Examiner*—Henry C. Yuen
*Assistant Examiner*—M. Macy
*Attorney, Agent, or Firm*—Dennis C. Skarvan

[57] ABSTRACT

A cylinder liner assembly for an internal combustion engine is disclosed. The assembly includes a cylinder head, a cylinder block defining a top deck surface and a cylinder bore extending from the top deck surface, and a cylinder liner mounted in the cylinder bore. The cylinder liner includes a flanged end extending over the top deck surface of the cylinder block. A hardened annular deck plate is provided about the cylinder bore between the flanged end of the cylinder liner and the cylinder block to prevent cracking of the cylinder block when the flanged end is clamped between the cylinder head and the cylinder block. The hardened annular deck plate has a hardness in the range of about 25 to about 60 on a Rockwell "C" scale, and preferably about 50 on a Rockwell "C" scale.

17 Claims, 4 Drawing Sheets

DECK PLATE FOR AN INTERNAL COMBUSTION ENGINE

TECHNICAL FIELD

This invention relates generally to support structures for cylinder liners of an internal combustion engine and, more particularly, to a removable hardened deck plate mounted between the cylinder block and removable cylinder liner of an internal combustion engine to reduce cracking of the cylinder block.

BACKGROUND ART

Prior support structures for use with internal combustion engines having cylinder liners have been directed generally to supporting lightweight engine cylinder blocks and/or liners against high combustion gas loads. See for example U.S. Pat. Nos. 4,757,790 and 4,858,462 to Ushio et al.

In addition to supporting the block and liner against high combustion gas loads, internal combustion engines must also support the block and/or liner against thermal and mechanical loads. For example, in an internal combustion engine including removable flanged cylinder liners top or mid-supported by the cylinder block, manufacturing tolerances and thermal distortion can cause high localized contact stresses in the abutment of the cylinder liner flange with the cylinder block. For flanged cylinder liners supported by the top surface or deck of the cylinder block, cracking of the top deck adjacent to the cylinder bore occurs. Left unchecked, crack propagation between adjacent cylinder bores can result in loss of compression and reduced engine performance.

Further, overhaul of the engine is made more difficult. For small cracks in the top deck of the cylinder block observed during overhaul, the deck is typically counterbored around the cylinder bore to a depth which eliminates the cracks, and a cylindrical ring is inserted between the cylinder liner flange and counterbore to reestablish the cylinder liner flange height. However, the cylindrical ring, like the cylinder block, is still subject to high localized stresses and cracking due to manufacturing tolerances and thermal distortions. Further, additional shims are typically required to reestablish the proper cylinder liner flange height. If the cracks have propagated beyond the permissible repair range, the cylinder block must be replaced.

Therefore, a need exists for an improved abutment of the cylinder liner to the cylinder block which reduces cracking of the cylinder block. Preferably, such an abutment should be easily repairable without affecting engine performance. Ideally, such an abutment should be retrofittable to existing engines.

DISCLOSURE OF THE INVENTION

According to one embodiment of the present invention, in an internal combustion having a cylinder liner mounted in a cylinder bore of a cylinder block, the cylinder liner including a flanged mounting surface received clamped on a corresponding mounting surface of the cylinder block, the improvement is disclosed comprising the mounting surface of the cylinder block having a hardness in the range of about 25 to about 60 on a Rockwell "C" scale.

According to another embodiment of the present invention, a cylinder head joint for an internal combustion engine is disclosed, comprising a cylinder head, a cylinder block including a cylinder bore, a cylinder liner mounted in the cylinder bore, the cylinder liner including a flanged end extending over the cylinder block, and a hardened annular plate disposed about the cylinder bore between the flanged end of the cylinder liner and the cylinder block, the hardened annular plate and the flanged end of the cylinder liner being clamped between the cylinder head and the cylinder block.

According to yet another embodiment of the present invention, a method of manufacture or repair of an internal combustion engine is disclosed, the internal combustion engine including a cylinder block defining a cylinder bore and a cylinder liner mountable in the cylinder bore, the cylinder liner including a flanged end extending over the cylinder block, the method comprising the steps of machining a counterbore in the cylinder block a predetermined depth about the cylinder bore, obtaining an annular plate having a predetermined thickness corresponding to the predetermined depth, the annular plate having a hardness in the range of about 25 to about 60 on a Rockwell "C" scale, placing the annular plate in the counterbore, placing the cylinder liner in the cylinder bore with the flanged end extending over the annular plate, and clamping the flanged end of the cylinder liner to the annular plate.

BEST MODE FOR CARRYING OUT THE INVENTION

Figure 1:
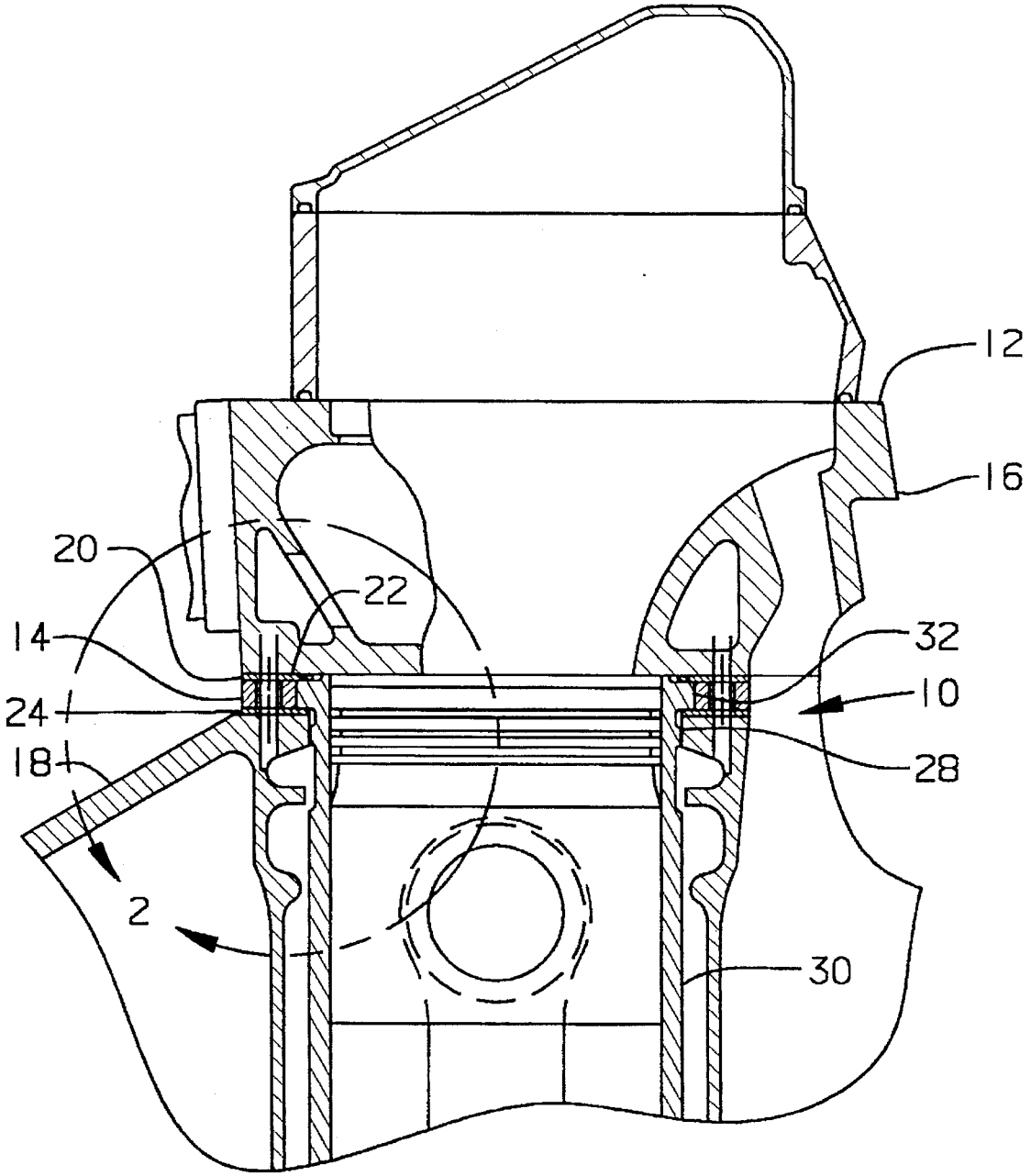
FIG. 1 is a partial cross-sectional view of a cylinder head joint according to one embodiment of the present invention.
Figure 2:
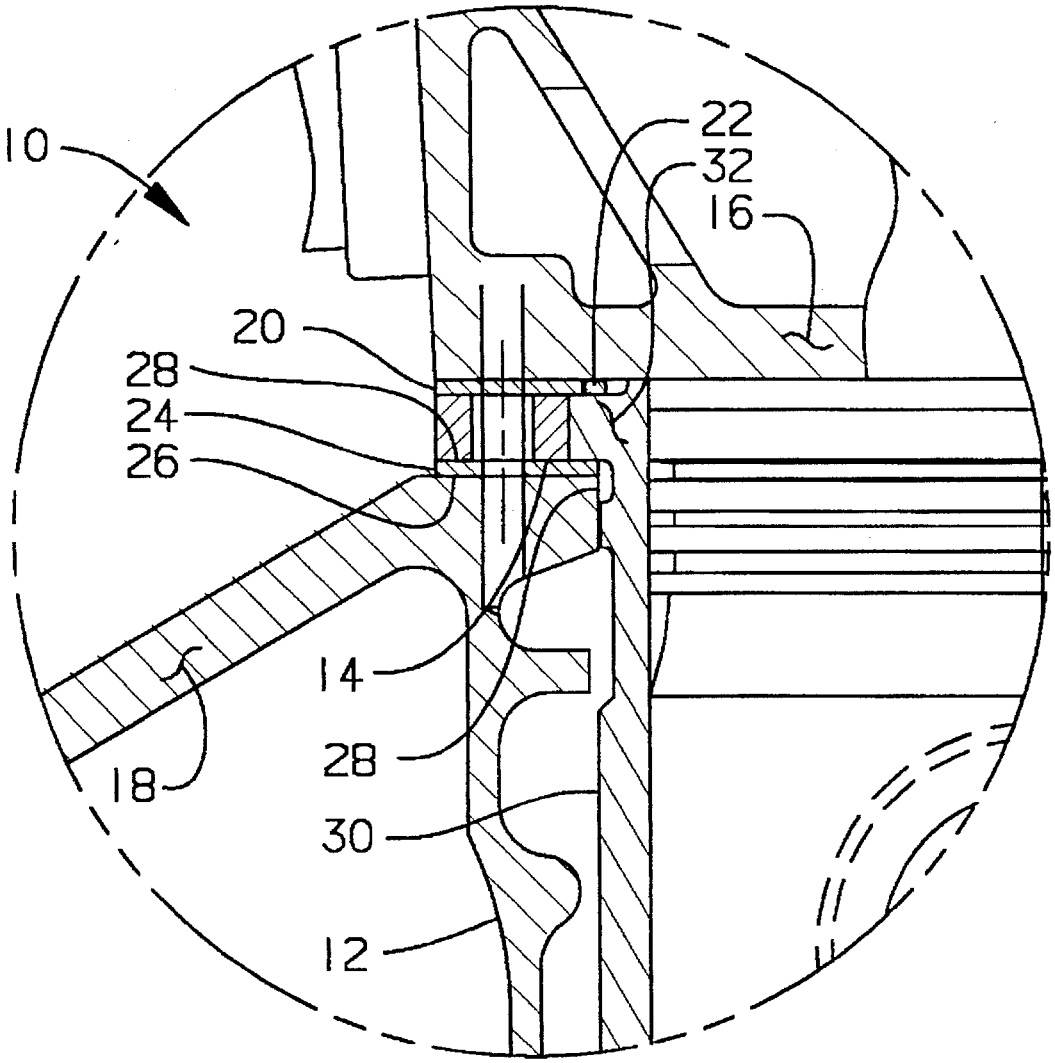
FIG. 2 is an exploded partial cross-sectional view of a portion of the cylinder head joint of FIG. 1.

Referring now to FIGS. 1 and 2, a cylinder head joint 10 is shown in an internal combustion engine 12. Cylinder head joint 10 includes a spacer plate 14 clamped between a cylinder head 16 and cylinder block 18. A conventional head gasket 20 including a combustion gas seal or fire ring 22 is mounted between cylinder head 16 and spacer plate 14. A deck plate 24 is mounted directly between the top surface or deck 26 of cylinder block 18 and spacer plate 14.

Cylinder block 18 includes a number of cylinder bores 28 in which are provided a corresponding number of cylinder liners 30. Cylinder liners 30 include flanges 32 which are clamped between cylinder head 16 and deck plate 24 to mount liners 30 within bores 28. In the specific preferred embodiment shown, the cylinder block and liners are constructed of like material, such as cast iron having a hardness of about 4 to about 5 on the Rockwell "B" scale, to reduce thermal growth differentials and associated stresses. However, a cylinder block and liner constructed of differing materials are contemplated as well which would benefit from the present invention. Similarly, mid-supported cylinder liners which include a flange approximately mid-liner that seats on a corresponding step or flange in the cylinder bore would benefit from the present invention.

Present overhaul techniques for cracked cylinder blocks include machining a counterbore around the cylinder bore, mounting a non-hardened steel ring in the counterbore between the cylinder block and the cylinder liner flange and then shimming the cylinder liner to a desired height. The depth of the counterbore and the number of shims required to reestablish the proper cylinder flange height are dependent on the degree of machining required to eradicate cracks in the cylinder block. The present invention reduces cracking of the cylinder block, whether used in conjunction with a top or mid-supported liner, thereby eliminating the need for costly counterbore machining of the cylinder block and selective shimming of the cylinder liner flange within the counterbore. Instead, by machining the cylinder block to a predetermined height during manufacture and by providing a hardened deck plate having a predetermined thickness corresponding to the machined height of the top deck of the cylinder block, the height of the cylinder liner is precisely set during manufacture.

According to the present invention, the top surface 28 of deck plate 24 abutting flange 32 of liner 30 has a hardness in the range of about 25 to about 60 measured on the Rockwell "C" scale to withstand the high localized stresses imposed by flange 32 onto the deck plate. In the specific preferred embodiment, deck plate 24 is constructed from hard drawn commercial quality carbon steel spring stock and through-hardened to a hardness of about 50 on the Rockwell "C" scale. See, for example, tempered carbon steel specifications SAE J316 or ASTM A229 and stainless steel specifications SAE 30301 and 30302 or ASTM A313.

Figure 3:
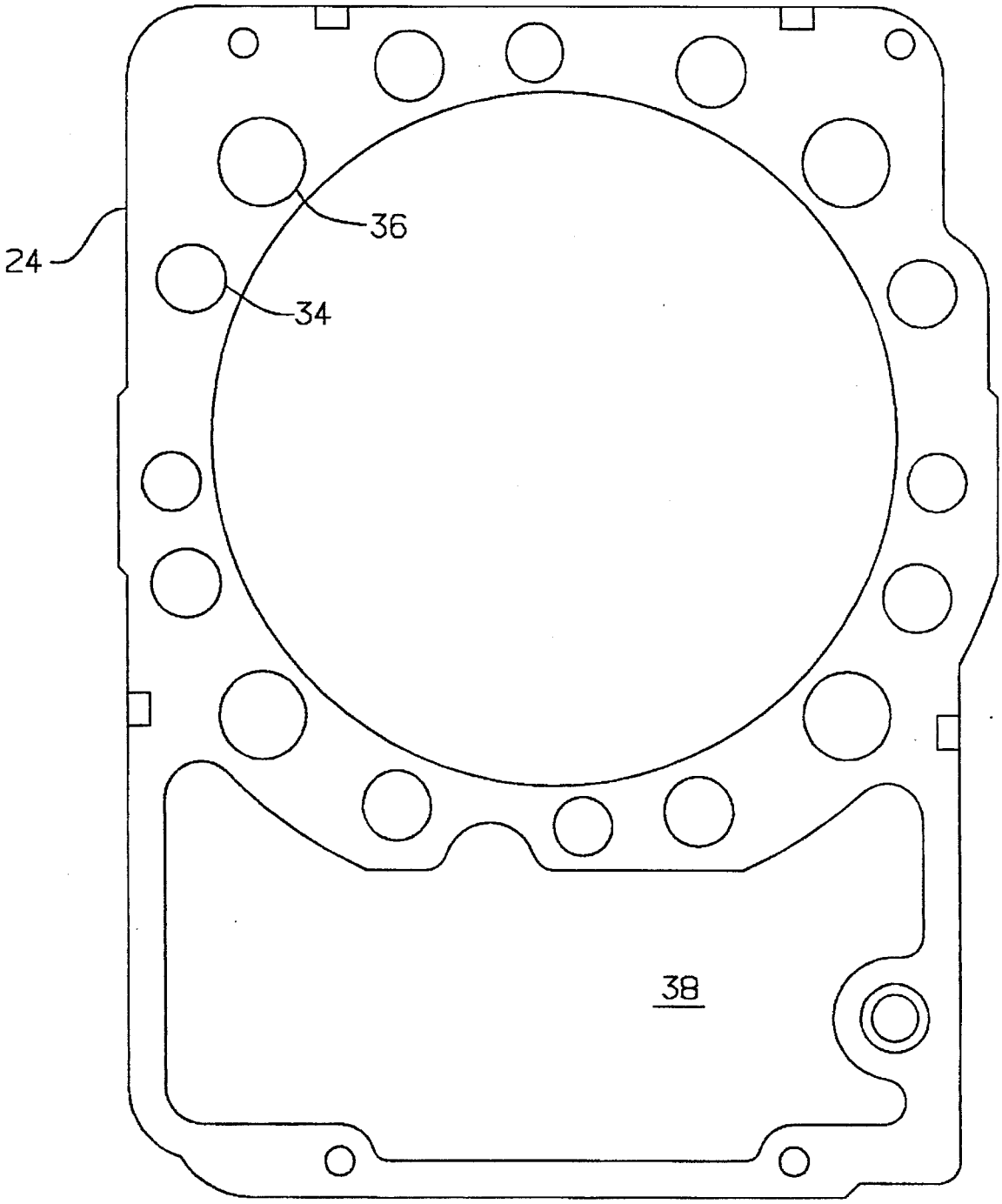
FIG. 3 is a plan view of a hardened deck plate of the cylinder head joint of FIG. 1.
Figure 4:
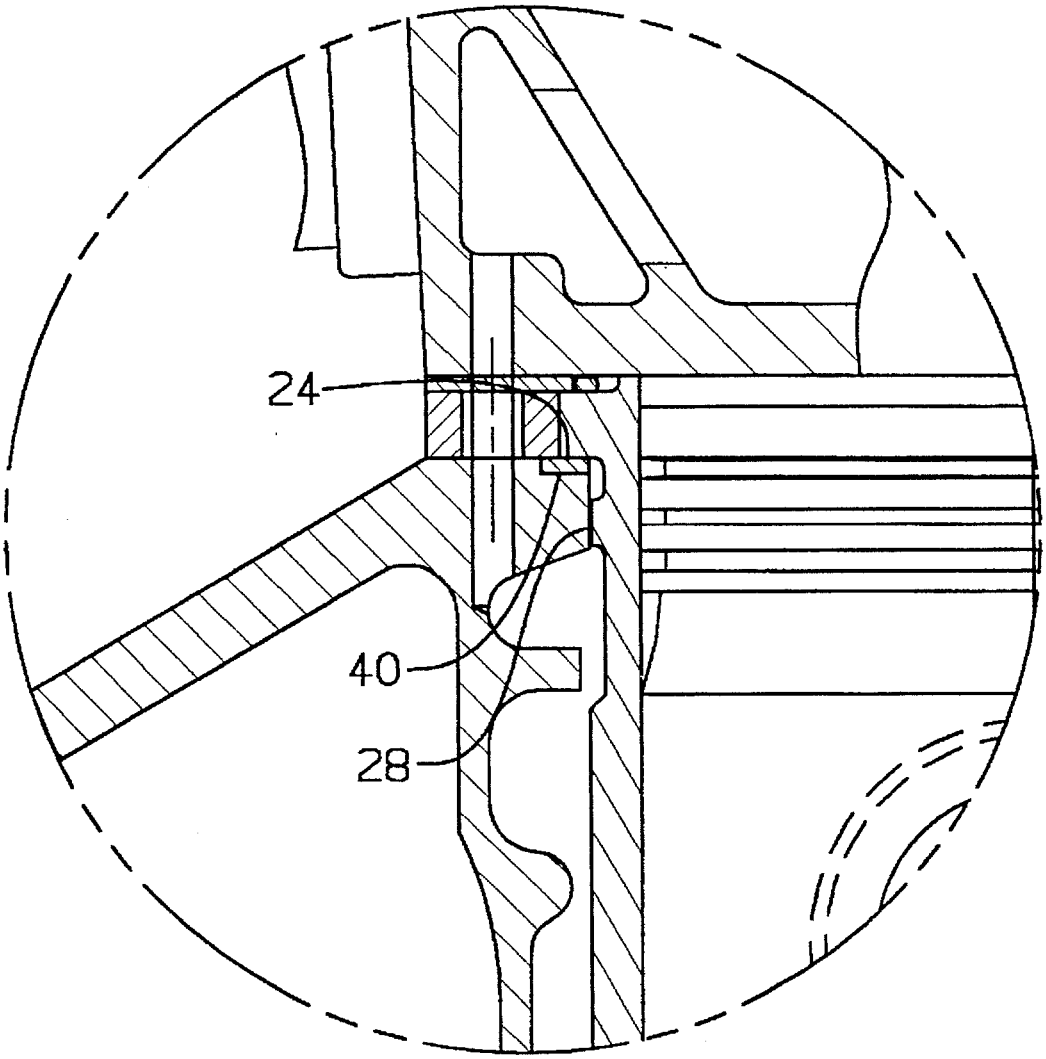
FIG. 4 is a partial cross-sectional view of a cylinder head joint according to a second embodiment of the present invention.

The shape of deck plate 24 can vary according to the application. For example, in FIG. 3, deck plate 24 has a shape corresponding to the shape of spacer plate 14. As such, deck plate 24 includes a plurality of bolt holes 34, coolant holes 36 and a lifter compartment through hole 38. In the specific preferred embodiment shown, coolant ferrules and a lifter compartment gasket (not shown) seal across the various coolant holes and lifter compartment through hole between the cylinder head and cylinder block, thereby permitting deck plate 24 to be mounted directly between spacer plate 14 and cylinder block 18. Alternately, deck plate 24 can incorporate gaskets on either side thereof for sealing across the various coolant holes and the lifter compartment through hole, wherein deck plate 24 is mounted contacting the adjoining parts. Deck plate 24 can also be shaped corresponding to the cylinder bore. For example, in FIG. 4 deck plate 24 is a flat cylindrical ring mounted in a counterbore 40 about cylinder bore 28.

Regardless of the configuration chosen for the deck plate, deck plate 24 is retrofittable in engines during overhaul. By either milling the top deck or machining a counterbore about the cylinder liner, a hardened deck plate can be inserted clamped between the flanged cylinder liner and the cylinder block to reduce cracking due to high contract stresses between the cylinder liner flange and block.

In either of the deck plate embodiments shown, the deck plate 24 is preferably constructed approximately 0.794+/−0.025 millimeters thick, although other thicknesses are contemplated as well depending on the particular application and loading. As such, the present invention is also retrofittable without further shimming by either milling or counterboring approximately 0.794 millimeters of stock from the top deck of the cylinder block and clamping deck plate 24 between the cylinder liner flange and cylinder block in place of the milled material.

I claim:

1. In an internal combustion engine having a cylinder liner mounted in a cylinder bore of a cylinder block, said cylinder liner including a flanged mounting surface clamped on a corresponding mounting surface of said cylinder block, the improvement comprising said mounting surface of said cylinder block having a hardness in the range of 25 to 60 on a Rockwell "C" scale.

2. The improvement of claim 1, wherein said cylinder block includes a hardened plate defining said mounting surface of said cylinder block, said hardened plate being clamped between said cylinder liner and said cylinder block.

3. The improvement of claim 2, wherein said hardened plate has a hardness of about 50 on a Rockwell "C" scale.

4. The improvement of claim 3, wherein said cylinder block is constructed of cast iron and said hardened plate is constructed of steel.

5. The improvement of claim 4, wherein said hardened plate is through hardened.

6. The improvement of claim 5, wherein said cylinder block includes a top deck surface and said cylinder liner includes a flanged end defining said flanged mounting surface of said cylinder liner, said hardened plate being clamped between said top deck surface and said flanged end.

7. A cylinder head joint for an internal combustion engine, comprising:

a cylinder head;

a cylinder block including a cylinder bore;

a cylinder liner mounted in said cylinder bore, said cylinder liner including a flanged end extending over said cylinder block; and a hardened annular plate disposed about said cylinder bore between said flanged end of said cylinder liner and said cylinder block, said hardened annular plate and said flanged end of said cylinder liner being clamped between said cylinder head and said cylinder block.

8. The cylinder head joint of claim 7, and further comprising:

a spacer plate clamped between said cylinder head and a top deck surface of said cylinder block, said spacer plate including a cylinder liner through hole adapted for receiving said flanged end of said cylinder liner therein;

wherein said top deck surface includes a counterbore about said cylinder bore and said hardened annular plate is received in said counterbore substantially flush with said top deck surface, said flanged end of said cylinder liner being received in said cylinder liner through hole clamped between said cylinder head and said hardened deck plate.

9. The cylinder head joint of claim 8, wherein said hardened annular plate has a hardness in the range of 25 to 60 on a Rockwell "C" scale.

10. The cylinder head joint of claim 9, wherein said hardened annular plate has a hardness of about 50 on a Rockwell "C" scale.

11. The improvement of claim 10, wherein said hardened annular plate is through hardened.

12. The cylinder head joint of claim 7, and further comprising:

a spacer plate including a cylinder liner through hole adapted for receiving said flanged end of said cylinder liner therein;

wherein said hardened annular plate has a shape corresponding to the shape of said spacer plate, said spacer plate and said hardened deck plate being clamped between said cylinder head and a top deck surface of said cylinder block.

13. The cylinder head joint of claim 12, wherein said hardened annular plate has a hardness in the range of 25 to 60 on a Rockwell "C" scale.

14. The cylinder head joint of claim 13, wherein said hardened annular plate has a hardness of about 50 on a Rockwell "C" scale.

15. The improvement of claim 14, wherein said hardened annular plate is through hardened.

16. A method of manufacture or repair for an internal combustion engine, the internal combustion engine including a cylinder block defining a cylinder bore and a cylinder liner mountable in the cylinder bore, the cylinder liner including a flanged end extending over the cylinder block, the method comprising the steps of:

machining a counterbore in the cylinder block a predetermined depth about the cylinder bore;

obtaining an annular plate having a predetermined thickness corresponding to said predetermined depth, said annular plate having a hardness in the range of 25 to 60 on a Rockwell "C" scale;

placing said annular plate in said counterbore;

placing the cylinder liner in the cylinder bore with the flanged end extending over said annular plate; and clamping the flanged end of the cylinder liner to said annular plate.

17. A method of manufacture or repair for an internal combustion engine, the internal combustion engine including a cylinder head, a cylinder block including a top deck surface and a cylinder bore extending from the top deck surface, a cylinder liner mountable in the cylinder bore, and a spacer plate adapted for receipt which is clamped between the cylinder head and the top deck surface, the spacer plate including a cylinder liner through hole and the cylinder liner including a flanged end adapted for receipt in the cylinder liner through hole and extending over the top deck surface, the method comprising the steps of:

machining the top deck surface a predetermined depth;

obtaining a deck plate having a shape corresponding to the shape of the spacer plate and a predetermined thickness corresponding to said predetermined depth, said deck plate having a hardness in the range of 25 to 60 on a Rockwell "C" scale;

placing said deck plate on the top deck surface;

placing the spacer plate on said deck plate;

placing the cylinder liner in the cylinder bore with the flanged end received in the cylinder liner through hole and extending over said deck plate; and clamping the spacer plate and said deck plate between the cylinder head and the top deck surface, wherein the flanged end of the cylinder liner is clamped between the cylinder head and said deck plate.

* * * * *